US011448157B2

(12) United States Patent
Nose et al.

(10) Patent No.: US 11,448,157 B2
(45) Date of Patent: Sep. 20, 2022

(54) CONTROLLER FOR INTERNAL COMBUSTION ENGINE, CONTROL METHOD FOR INTERNAL COMBUSTION ENGINE, AND MEMORY MEDIUM

(71) Applicant: TOYOTA JIDOSHA KABUSHIKI KAISHA, Toyota (JP)

(72) Inventors: Yuki Nose, Nagoya (JP); Yuto Ikeda, Okazaki (JP); Takanobu Gotoh, Obu (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/457,520

(22) Filed: Dec. 3, 2021

(65) Prior Publication Data

US 2022/0235724 A1 Jul. 28, 2022

(30) Foreign Application Priority Data

Jan. 28, 2021 (JP) ..... JP2021-011849

(51) Int. Cl.
*F02D 41/40* (2006.01)
*F02D 41/14* (2006.01)
(Continued)

(52) U.S. Cl.
CPC ..... *F02D 41/402* (2013.01); *F02D 41/1454* (2013.01); *F02D 41/36* (2013.01); *F02D 2041/389* (2013.01)

(58) Field of Classification Search
CPC ..... F02D 31/007; F02D 41/00; F02D 41/008; F02D 41/0085; F02D 41/024; F02D 41/14; F02D 41/1454; F02D 41/1475; F02D 41/36; F02D 41/40; F02D 41/401; F02D 41/402; F02D 2041/389
See application file for complete search history.

(56) References Cited

U.S. PATENT DOCUMENTS 10,208,686 B1 * 2/2019 Thomas ..... F02D 41/2477
10,655,555 B2 5/2020 Nagakura
(Continued)

FOREIGN PATENT DOCUMENTS

DE 2749742 A1 12/1978
DE 102010038821 B3 2/2012
(Continued)

*Primary Examiner* — John Kwon
*Assistant Examiner* — Johnny H Hoang
(74) *Attorney, Agent, or Firm* — Oblon, McClelland, Maier & Neustadt, L.L.P.

(57) ABSTRACT

A controller and a control method for internal combustion engine, and a memory medium are provided. A port injection ratio is changed according to an engine operating state of the internal combustion engine. The port injection ratio is a ratio of a port injection amount that is an amount of fuel injected by port injection valves to an amount of fuel supplied to cylinders from the port injection valves and direct injection valves. An injection reducing process causes a fuel injection amount in a reduced-injection cylinder to be smaller than a fuel injection amount in other cylinders. An increase limiting process limits increases in an adhered fuel amount in intake ports by regulating the port injection ratio during execution of the injection reducing process.

8 Claims, 4 Drawing Sheets

(51) Int. Cl.
*F02D 41/36* (2006.01)
*F02D 41/38* (2006.01)

(56) References Cited

U.S. PATENT DOCUMENTS

| | | | | |
|---|---|---|---|---|
| 2018/0202385 | A1* | 7/2018 | Miwa | B60K 6/445 |
| 2018/0230929 | A1 | 8/2018 | Kitazume et al. | |
| 2018/0313291 | A1* | 11/2018 | Higuchi | F02D 41/3094 |
| 2018/0347494 | A1* | 12/2018 | Sanborn | F02D 41/221 |
| 2019/0338720 | A1 | 11/2019 | Banker et al. | |

FOREIGN PATENT DOCUMENTS

| | | | |
|---|---|---|---|
| JP | 2007-332867 | A | 12/2007 |
| JP | 2019-85948 | A | 6/2019 |

* cited by examiner

CONTROLLER FOR INTERNAL COMBUSTION ENGINE, CONTROL METHOD FOR INTERNAL COMBUSTION ENGINE, AND MEMORY MEDIUM

BACKGROUND

1. Field

The present disclosure relates to a controller for an internal combustion engine, a control method for an internal combustion engine, and a memory medium.

2. Description of Related Art

For example, an internal combustion engine disclosed in Japanese Laid-Open Patent Publication No. 2019-85948 includes port injection valves, which inject fuel to intake ports, and direct injection valves, which inject fuel into combustion chambers. According to the document, a dither control is executed as an injection reducing process that restores the function of an exhaust purifying member in an exhaust passage.

The dither control changes the air-fuel ratio of air-fuel mixture by causing the fuel injection amount in one or some of multiple cylinders to be smaller than that of the other cylinders.

SUMMARY

During the execution of the injection reducing process, displacement of the air-fuel ratio of the air-fuel mixture from a proper value hinders recovery of the function of the exhaust purifying member. It is thus desirable to minimize such displacement of the air-fuel ratio from the proper value.

When port injection is performed, that is, when fuel injection from a port injection valve is performed, some of the injected fuel is likely to adhere to the intake port. If the fuel adhered to the intake port flows into the combustion chamber during the subsequent combustion cycle, the air-fuel ratio is likely to be displaced from the proper value. When the amount of fuel adhered to the intake port, or an adhered fuel amount, increases, the amount of displacement of the air-fuel ratio from the proper value may increase.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a controller for an internal combustion engine is provided. The internal combustion engine for which the controller is used includes cylinders, port injection valves that inject fuel into intake ports, and direct injection valves that inject fuel into the cylinders. The controller is configured to execute: a process that changes a port injection ratio according to an engine operating state of the internal combustion engine, the port injection ratio being a ratio of a port injection amount that is an amount of fuel injected by the port injection valves to an amount of fuel supplied to the cylinders from the port injection valves and the direct injection valves; an injection reducing process that causes a fuel injection amount in a reduced-injection cylinder to be smaller than a fuel injection amount in other cylinders, the reduced-injection cylinder being one or some of the cylinders; and an increase limiting process that limits increases in an adhered fuel amount in the intake ports by regulating the port injection ratio during execution of the injection reducing process.

This configuration executes the increase limiting process, which limits increases in the amount of fuel adhered to the intake port, during the execution of the injection reducing process. Accordingly, new fuel is unlikely to adhere to the intake port, which limits increases in the adhered fuel amount. Displacement of the air-fuel ratio from the proper value is thus unlikely to increase due to increases in the adhered fuel amount.

In the above-described controller, the increase limiting process may include a process that reduces the port injection ratio over time.

This configuration reduces the port injection ratio over time during the execution of the injection reducing process. Accordingly, the port injection amount, which is the fuel injection amount of the port injection valve, gradually decreases. As the port injection amount gradually decreases, new fuel is unlikely to adhere to the intake port, which limits increases in the adhered fuel amount. This limits increases in the displacement of the air-fuel ratio from the proper value. When the port injection amount decreases gradually, the fuel adhered to the intake port gradually decreases. The adhered fuel amount thus decreases. Accordingly, the displacement of the air-fuel ratio from the proper value is reduced.

In the above-described controller, the increase limiting process may include a process that stops a port injection that is a fuel injection from the port injection valves.

This configuration stops the port injection and performs fuel injection only from the direct injection valve during the execution of the injection reducing process. When the port injection is stopped, new fuel does not adhere to the intake port, which limits increases in the adhered fuel amount. This limits the increase in the displacement of the air-fuel ratio from the proper value. Also, when the port injection is stopped, the fuel adhered to the intake port gradually decreases. The adhered fuel amount thus decreases. Accordingly, the displacement of the air-fuel ratio from the proper value is reduced.

In the above-described controller, the increase limiting process may include a process that limits the port injection ratio such that the port injection ratio does not exceed a value of the port injection ratio at a start of the injection reducing process.

During the execution of the injection reducing process, this configuration limits the port injection ratio such that the port injection ratio will not exceed the port injection ratio value at the time when the injection reducing process was started. This limits increases in the port injection amount. Accordingly, new fuel is unlikely to adhere to the intake port, which limits increases in the adhered fuel amount. This limits increases in the displacement of the air-fuel ratio from the proper value.

The above-described may controller is configured to perform a split injection in which fuel injection of the direct injection valves is split to two or more injections, and to execute a changing process that reduces a split injection count during execution of the injection reducing process.

With this configuration, execution of the changing process reduces a split injection count, which is the number of times the split injection is performed if the split injection of the direct injection valve is performed during the execution of the injection reducing process. As the split injection count decreases, the fuel injection amount in a single injection of the direct injection increases. This improves the fuel injection accuracy. Accordingly, the displacement of the air-fuel ratio from the proper value due to deterioration of the fuel injection accuracy is reduced.

Further, the above-described controller may be configured to perform an air-fuel ratio feedback control for an air-fuel mixture when the injection reducing process is not being executed, and to prohibiting the air-fuel ratio feedback control when the injection reducing process is being executed.

Another general aspect provides a control method for an internal combustion engine that executes the various processes described in any one of the above-described configurations.

A further general aspect provides a non-transitory computer readable memory medium that stores a program that causes a processor to execute the various processes described in any one of the above-described configurations.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

A controller 70 for an internal combustion engine 10 according to a first embodiment will now be described with reference to FIGS. 1 to 3.

Figure 1:
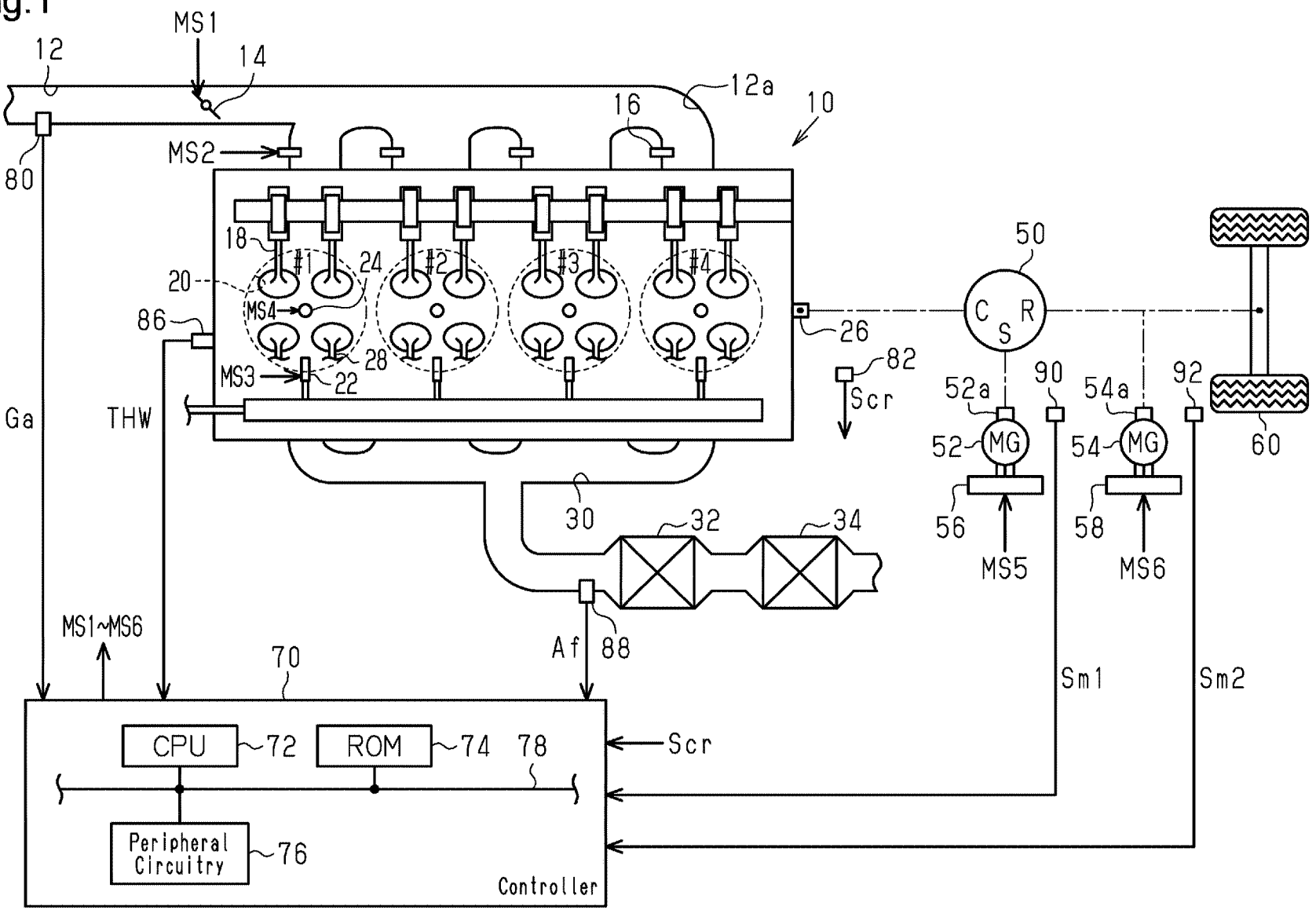
FIG. 1 is a diagram showing a configuration of an internal combustion engine, a drive system, and a controller according to a first embodiment.

As shown in FIG. 1, the internal combustion engine 10 includes four cylinders #1 to #4. The internal combustion engine 10 includes a throttle valve 14 incorporated in an intake passage 12. The intake passage 12 includes intake ports 12*a* in a downstream section. Each intake port 12*a* is provided with a port injection valve 16, which injects fuel into the intake port 12*a*. Air drawn into the intake passage 12 and fuel injected from the port injection valves 16 flow into combustion chambers 20 when intake valves 18 are opened. A direct injection valve 22, which injects fuel into a cylinder, injects fuel into each combustion chamber 20. Air-fuel mixture in the combustion chamber 20 is burned by spark discharge of an ignition plug 24. This generates combustion energy, which is in turn converted into rotational energy of a crankshaft 26.

The air-fuel mixture burned in the combustion chambers 20 is discharged to an exhaust passage 30 as exhaust gas when exhaust valves 28 are opened. The exhaust passage 30 incorporates exhaust purifying members. The exhaust purifying members include a three-way catalyst 32, which has an oxygen storage capacity, and a gasoline particulate filter (GPF) 34. In the present embodiment, the GPF 34 traps particulate matter (PM) and supports a three-way catalyst that has an oxygen storage capacity.

The crankshaft 26 is mechanically coupled to a carrier C of a planetary gear mechanism 50, which is part of a power splitter. The planetary gear mechanism 50 includes a sun gear S, which is mechanically coupled to a rotary shaft 52*a* of a first motor-generator 52. The planetary gear mechanism 50 includes a ring gear R, which is mechanically coupled to a rotary shaft 54*a* of a second motor-generator 54 and to driven wheels 60. Alternating-current voltage of an inverter 56 is applied to terminals of the first motor-generator 52. Also, alternating-current voltage of an inverter 58 is applied to terminals of the second motor-generator 54.

The controller 70 controls the internal combustion engine 10 and operates operated units of the internal combustion engine 10, such as the throttle valve 14, the port injection valves 16, the direct injection valves 22, and the ignition plugs 24, thereby controlling torque and the ratios of exhaust components, which are controlled variables. Also, the controller 70 controls the first motor-generator 52. Specifically, the controller 70 operates the inverter 56, thereby controlling the rotation speed, which is a controlled variable, of the first motor-generator 52. Further, the controller 70 controls the second motor-generator 54. Specifically, the controller 70 operates the inverter 58, thereby controlling torque, which is a controlled variable, of the second motor-generator 54. FIG. 1 shows operation signals MS1 to MS6 respectively corresponding to the throttle valve 14, the port injection valves 16, the direct injection valves 22, the ignition plugs 24, and the inverters 56, 58. To control controlled variables of the internal combustion engine 10, the controller 70 refers to an intake air amount Ga detected by an air flow meter 80, an output signal Scr of a crank angle sensor 82, a coolant temperature THW detected by a coolant temperature sensor 86, and an air-fuel ratio Af detected by an air-fuel ratio sensor 88, which is provided on the upstream side of the three-way catalyst 32. Further, to control controlled variables of the first motor-generator 52 and the second motor-generator 54, the controller 70 refers to an output signal Sml of a first rotation angle sensor 90, which detects a rotation angle of the first motor-generator 52, and an output signal Sm2 of a second rotation angle sensor 92, which detects a rotation angle of the second motor-generator 54. The controller 70 calculates an engine rotation speed NE based on the output signal Scr. The controller 70 calculates an engine load factor KL on the basis of the engine rotation speed NE and the intake air amount GA. The engine load factor KL is a parameter that determines the amount of air filling the combustion chamber 20, and is the ratio of the inflow air amount per combustion cycle in one cylinder to a reference inflow air amount. The reference inflow air amount may be varied in accordance with the engine rotation speed NE.

The controller 70 includes a central processing unit (CPU) 72, a read-only memory (ROM) 74, and peripheral circuitry 76, which can communicate with each other through a communication line 78. The peripheral circuitry 76 includes a circuit that generates a clock signal regulating internal operations, a power supply circuit, and a reset circuit. The controller 70 controls the controlled variables by causing the CPU 72 to execute programs stored in the ROM 74.

The controller 70 executes, as one of various types of controlling processes for controlling the internal combustion engine 10, a process of switching among a port injection mode, a direct injection mode, and a dual injection mode according to the engine operating state. In the port injection mode, fuel is injected only from the port injection valves 16. In the direct injection mode, fuel is injected only from the direct injection valves 22. In the dual injection mode, fuel is injected from both the port injection valves 16 and the direct injection valves 22.

The switching of the injection mode described above is performed by variably changing a port injection ratio RP. The port injection ratio RP represents the ratio of a port injection amount QP, which is the amount of fuel injected from the port injection valves 16, to a total injection amount Q, which is the fuel injection amount set based on the engine operating state of the internal combustion engine 10. The total injection amount Q, which is set based on the engine operating state, is the amount of fuel supplied into the cylinders from the port injection valves 16 and the direct injection valves 22. Thus, the port injection ratio RP represents the ratio of the port injection amount QP to the total injection amount Q supplied into the cylinders from the port injection valves 16 and the direct injection valves 22.

The port injection ratio RP is set variably within the range of $0 \leq RP \leq 1$ based on the engine operating state such as the engine load factor KL and the engine rotation speed NE. The port injection amount QP, which is the fuel injection amount of the port injection valves 16, is set to the amount of fuel obtained by multiplying the total injection amount Q by the port injection ratio RP. The value obtained by subtracting the port injection ratio RP from 1 is calculated as the direct injection ratio RD ($RD=1-RP$). The direct injection ratio RD represents the ratio of a direct injection amount QD, which is the fuel injection amount of the direct injection valves 22, to the total injection amount Q. The direct injection amount QD is set to the amount of fuel obtained by multiplying the total injection amount Q by the direct injection ratio RD.

For example, the port injection ratio RP is set to 1 and the direct injection ratio RD is set to 0 in a low load and low rotation speed region such as during idling. Also, the port injection ratio RP is set to 0 and the direct injection ratio RD is set to 1 in a high load region or a high rotation speed region. In other engine operating ranges, the port injection ratio RP is set variably within the range of $0<RP<1$. Accordingly, the direct injection ratio RD is set variably.

Also, the controller 70 performs split injection of the direct injection valves 22. In the split injection, the fuel injection from the direct injection valves 22 is split to two or more injections when the direct injection amount QD is greater than or equal to a defined value. The split injection count N is increased as the value of the direct injection amount QD increases. When the split injection is performed, the fuel injection amount from each direct injection valve 22 in a single injection decreases, so that the penetration of the injected fuel is reduced. This limits adhesion of fuel on the wall surfaces of the cylinders.

<Regeneration Process of GPF>

Figure 2:
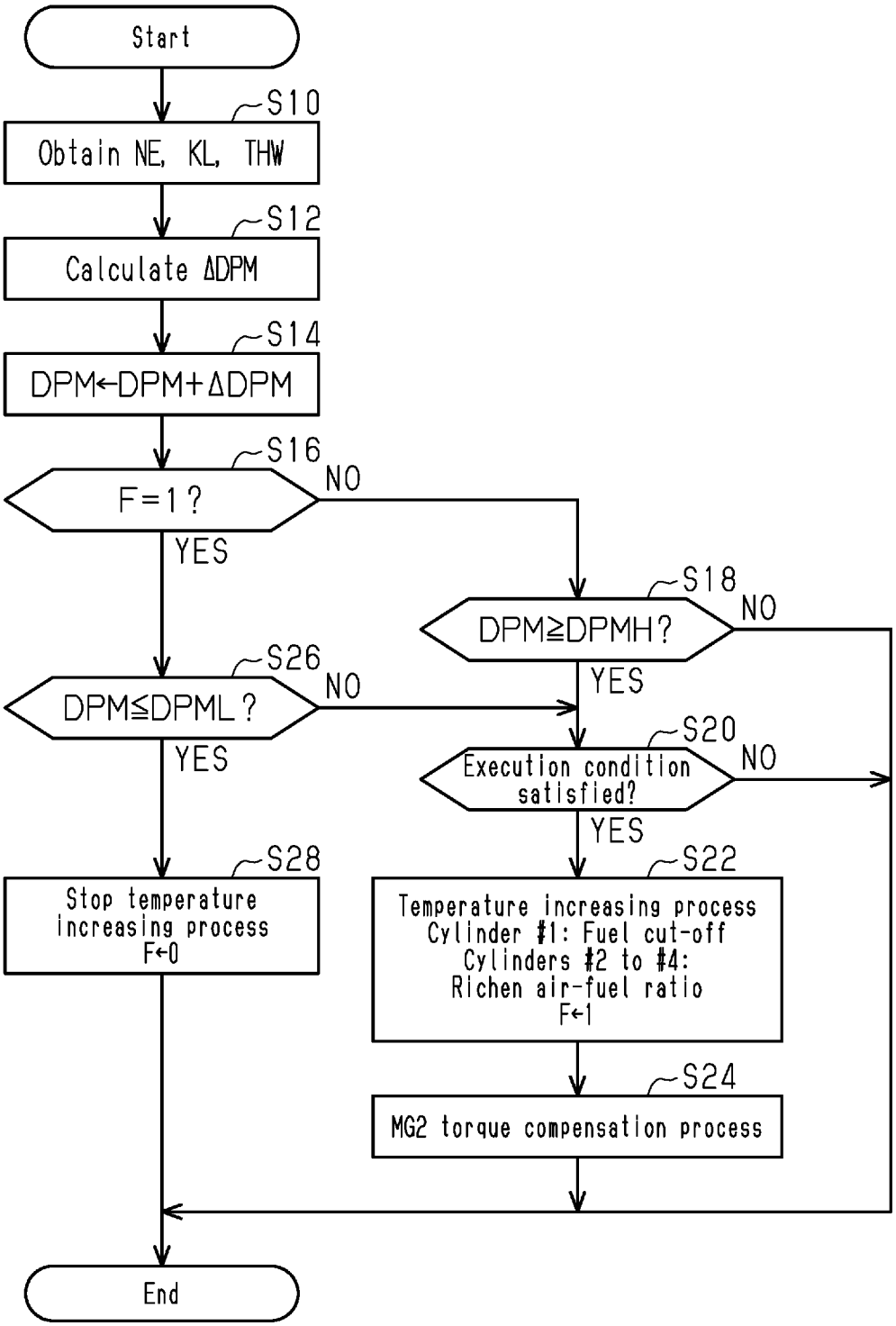
FIG. 2 is a flowchart showing a procedure of a regeneration process executed by the controller shown in FIG. 1.

FIG. 2 shows a procedure of processes executed by the controller 70 of the present embodiment. The process shown in FIG. 2 is implemented by the CPU 72 repeatedly executing programs stored in the ROM 74 at a specific interval. In the following description, the number of each step is represented by the letter S followed by a numeral.

In the series of processes shown in FIG. 2, the CPU 72 first obtains the engine rotation speed NE, the engine load factor KL, and the coolant temperature THW (S10).

Next, the CPU 72 calculates an update amount ADPM of an accumulated amount DPM based on the engine rotation speed NE, the engine load factor KL, and the coolant temperature THW (S12). The accumulated amount DPM is the amount of PM trapped by the GPF 34. Specifically, the CPU 72 calculates the amount of PM in the exhaust gas discharged to the exhaust passage 30 based on the engine rotation speed NE, the engine load factor KL, and the coolant temperature THW. Also, the CPU 72 obtains a temperature of the GPF 34 in another process. Further, the CPU 72 calculates the update amount ADPM based on the amount of PM in the exhaust gas and the temperature of the GPF 34.

Next, the CPU 72 updates the accumulated amount DPM in accordance with the update amount ΔDPM (S14).

Subsequently, the CPU 72 determines whether a flag F is 1 (S16). The value 1 of the flag F indicates that a temperature increasing process that burns and removing the PM in the GPF 34 is being executed, and the value 0 of the flag F indicates that the temperature increasing process is not being executed.

When determining that the flag F is 0 (S16: NO), the CPU 72 determines whether the accumulated amount DPM is greater than or equal to a regeneration execution value DPMH (S18). The regeneration execution value DPMH indicates that the amount of PM trapped by the GPF 34 has increased, and is set to a value at which removal of PM is desirable.

When determining that the accumulated amount DPM is greater than or equal to the regeneration execution value DPMH (S18: YES), the CPU 72 determines whether an execution condition for the temperature increasing process is satisfied (S20). The execution condition may be a condition that the logical conjunction of Condition (A) and Condition (B), which are shown below, is true.

Condition (A): A condition that an engine torque command value Te*, which is a command value of torque to the internal combustion engine 10, is greater than or equal to a specific value Teth.

Condition (B): A condition that the engine rotation speed NE of the internal combustion engine 10 is greater than or equal to a specific speed.

When determining that the execution condition for the temperature increasing process is satisfied (S20: YES), the CPU 72 executes the temperature increasing process and assigns 1 to the flag F (S22). The temperature increasing process executes an injection reducing process in order to recover the function of the GPF 34. The injection reducing process causes the fuel injection amount in a reduced-injection cylinder, which corresponds to one or some of the cylinders, to be smaller than that of the other cylinders. As the injection reducing process, the CPU 72 of the present embodiment executes a partial fuel cut-off process.

The partial fuel cut-off process includes a combustion stopping process that stops combustion of air-fuel mixture in the reduced-injection cylinder, which corresponds to one or some of the cylinders. The partial fuel cut-off process includes a fuel increasing process in combustion cylinders, which correspond to the remaining cylinders except the reduced-injection cylinder. The fuel increasing process includes a process that increases the amount of fuel supplied to the combustion chambers 20 of the combustion cylinders to an amount greater than that during non-execution time of the combustion stopping process, such that, at combustion of the air-fuel mixture in the combustion cylinders, the air-fuel ratio of the air-fuel mixture in the combustion cylinders is richer than the stoichiometric air-fuel ratio.

The combustion stopping process stops combustion of air-fuel mixture in the cylinder #1, which is a fuel cut-off cylinder, for example, by stopping fuel injection from the port injection valve 16 and the direct injection valve 22 in the cylinder #1. The fuel cut-off cylinder #1 is a cylinder in which the combustion stopping process is executed, and is also a reduced-injection cylinder. The combustion cylinders #2 to #4 are the remaining cylinders except the fuel cut-off cylinder #1. That is, the combustion cylinders #2 to #4 are cylinders in which combustion of air-fuel mixture is performed during the execution of the combustion stopping process.

The fuel increasing process causes the amount of fuel supplied to the combustion chambers 20 of the cylinder #2, the cylinder #3, and the cylinder #4 to be greater than that during non-execution time of the combustion stopping process, in order to supply unburned fuel to the exhaust passage 30. At the execution of the fuel increasing process, the total injection amount Q, which is the fuel injection amount of the cylinder #2, the cylinder #3, and the cylinder #4, is set to a value obtained by multiplying a base injection amount Qb by an increase factor K. The base injection amount Qb causes the air-fuel ratio of the air-fuel mixture to be the stoichiometric air-fuel ratio. The CPU 72 sets the increase factor K such that the amount of unburned fuel in the exhaust gas discharged to the exhaust passage 30 from the cylinders #2, #3, and #4 is less than or equal to the amount that reacts with oxygen discharged from the cylinder #1 without excess or deficiency. Specifically, in order to increase the temperature of the three-way catalyst 32 at an early stage in the beginning of the regeneration process of the GPF 34, the CPU 72 sets the air-fuel ratio of the air-fuel mixture in the cylinders #2, #3, and #4 to a value that is closest to the amount that reacts with the oxygen discharged from the cylinder #1 without excess or deficiency. When executing the temperature increasing process (S22), the CPU 72 stops, that is, prohibits, an air-fuel ratio feedback control for air-fuel mixture. The reason for stopping the air-fuel ratio feedback control is because the oxygen discharged from the fuel cut-off cylinder #1 to the exhaust passage 30 would reduce the detection accuracy of the air-fuel ratio sensor 88.

When the partial fuel cut-off process is executed, oxygen and unburned fuel are discharged to the exhaust passage 30, so that the unburned fuel is oxidized in the three-way catalyst 32. This increases the temperature of the three-way catalyst 32. When the temperature of the three-way catalyst 32 is relatively high, high-temperature exhaust gas flows into the GPF 34, so that the temperature of the GPF 34 is increased. When oxygen flows into the heated GPF 34, the PM trapped by the GPF 34 is removed through oxidation.

The CPU 72 executes an MG2 torque compensation process in order to compensate for reduction in the engine output due to the execution of the combustion stopping process (S24). In the MG2 torque compensation process, the CPU 72 superimposes compensation torque, which is output torque of a single cylinder, on the torque required for the second motor-generator 54 for driving the vehicle. The CPU 72 controls the inverter 58 based on the required torque on which the compensation torque is superimposed.

When determining that the flag F is 1 in the process of S16 (S16: YES), the CPU 72 determines whether the accumulated amount DPM is less than or equal to a stopping threshold DPML (S26). The stopping threshold DPML is set to a value that indicates that the amount of PM trapped in the GPF 34 has been reduced to a sufficiently low level that allows the temperature increasing process to be stopped. When determining that the accumulated amount DPM is less than or equal to the stopping threshold DPML (S26: YES), the CPU 72 stops the execution of the partial fuel cut-off process in order to stop the temperature increasing process, and assigns 0 to the flag F (S28). After stopping the temperature increasing process, the CPU 72 restarts the air-fuel ratio feedback control. That is, the CPU 72 uses the difference between the air-fuel ratio Af and the target air-fuel ratio as an input and calculates an operated amount used to perform feedback control in order to cause the air-fuel ratio Af to be the target air-fuel ratio. Using the operated amount, the CPU 72 corrects the amount of fuel injected by at least one of the port injection valves 16 and the direct injection valves 22.

When completing the process of S24 or S28, or when making a negative determination in the process of S18 or S20, the CPU 72 temporarily suspends the series of processes shown in FIG. 2.

<Increase Limiting Process and Changing Process>

During the execution of the temperature increasing process, the controller 70 executes the increase limiting process, which limits increases in the amount of fuel adhered to the intake ports 12*a*, and the changing process, which reduces the split injection count N.

Figure 3:
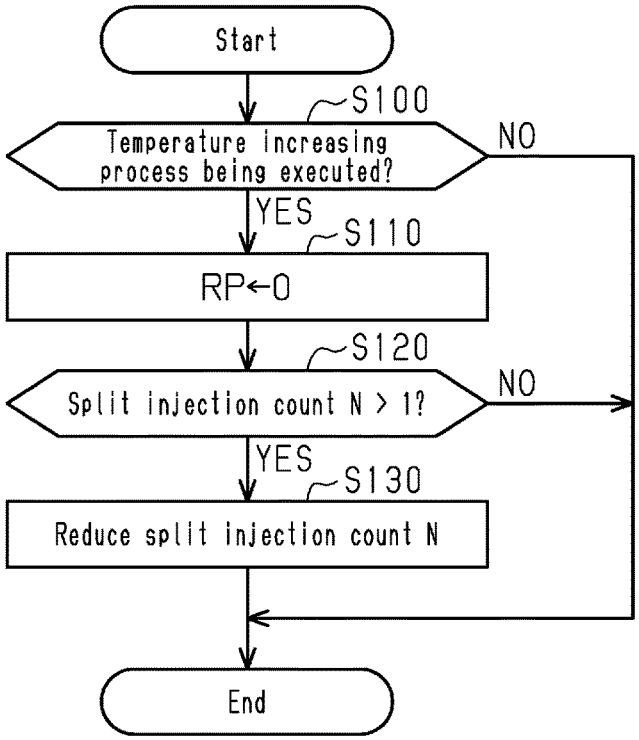
FIG. 3 is a flowchart showing a procedure of a process executed by the controller shown in FIG. 1.

FIG. 3 shows a procedure of processes executed by the controller 70 executing the increase limiting process and the changing process. The process shown in FIG. 3 is implemented by the CPU 72 repeatedly executing programs stored in the ROM 74 at a specific interval.

In the series of processes shown in FIG. 3, the CPU 72 first determines whether the temperature increasing process is being executed (S100). When determining that the temperature increasing process is being executed (S100: YES), the CPU 72 executes a process that sets the port injection ratio RP to 0 (S110) as the increase limiting process. When the port injection ratio RP is set to 0, the fuel injection from the port injection valves 16 is stopped, so that only the fuel injection from the direct injection valves 22 is performed.

Then, the CPU 72 obtains the current split injection count N of the direct injection and determines whether the value of the split injection count N is greater than 1, that is, whether the direct injection valves 22 are instructed to perform the split injection (S120). When determining that the split injection count N is greater than 1 (S120: YES), the CPU 72 executes the changing process to reduce the split injection count N (S130). In S130, the split injection count N is set to a new value obtained by subtracting a defined value, which is, for example, 1, from the split injection count N. After executing the process of S130, the CPU 72 temporarily suspends the current process.

When making a negative determination in the process of S100 or S120, the CPU 72 temporarily suspends the series of processes shown in FIG. 3.

<Operation and Advantages of Present Embodiment>

Operation and advantages of the present embodiment will now be described.

(1-1) During the execution of the temperature increasing process, the port injection ratio RP is set to 0. Thus, the fuel injection from the port injection valves 16 is stopped, and only the fuel injection from the direct injection valves 22 is performed. When the fuel injection from the port injection valves 16 is stopped, new fuel does not adhere to the intake ports 12*a*, which limits increases in the adhered fuel amount. This limits increases in the displacement of the air-fuel ratio from the proper value.

(1-2) When the fuel injection from the port injection valves 16 is stopped, the fuel adhered to the intake ports 12*a* gradually decreases. That is, the adhered fuel amount decreases. Accordingly, the displacement of the air-fuel ratio from the proper value is reduced.

(1-3) The split injection count N is reduced through the execution of the changing process if the split injection of the direct injection valves 22 is performed during the execution of the temperature increasing process. As the split injection count N decreases, the amount of fuel injection in a single injection of the direct injection increases. This improves the fuel injection accuracy. Accordingly, the displacement of the air-fuel ratio from the proper value due to deterioration of the fuel injection accuracy is reduced.

In the first embodiment, the process that stops the port injection is executed as the increase limiting process that limits increases in the adhered fuel amount on the intake ports 12*a*. In a second embodiment, the increase limiting process is executed in a manner different from that in the first embodiment.

The second embodiment will now be described with reference to FIG. 4. Differences from the processes according to the first embodiment shown in FIG. 3 will mainly be discussed.

<Increase Limiting Process>

Figure 4:
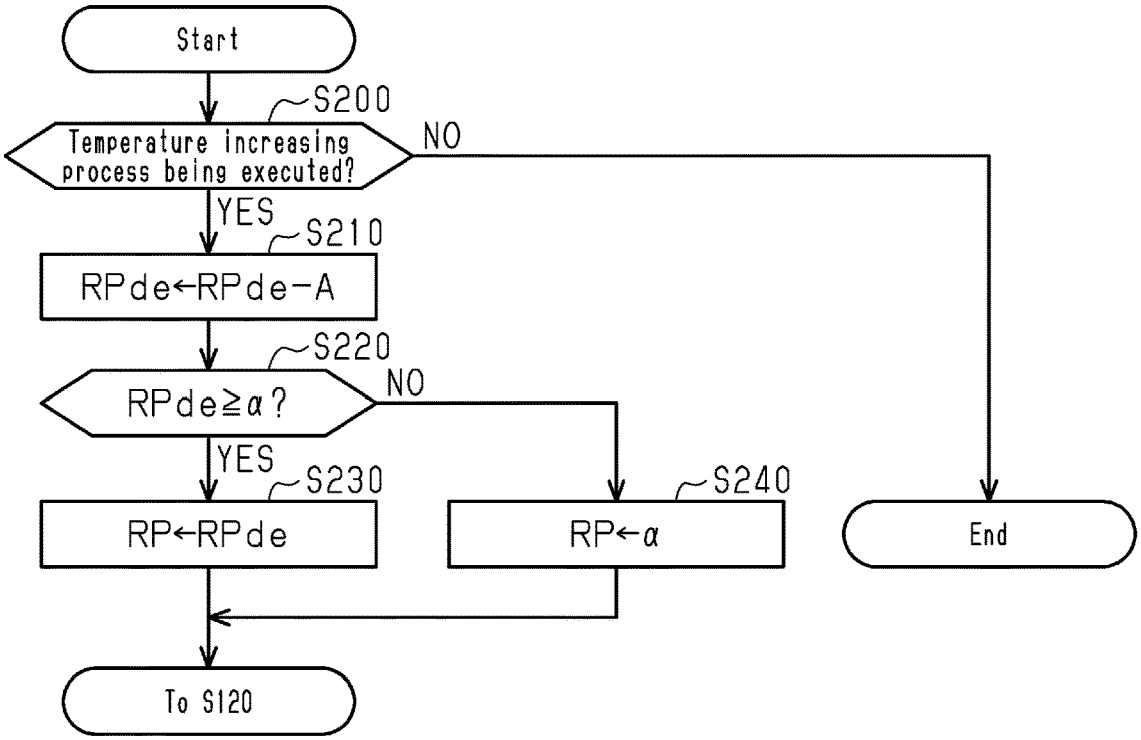
FIG. 4 is a flowchart showing a procedure of part of a process executed by a controller according to a second embodiment.

FIG. 4 shows a procedure of processes according to the present embodiment. The process shown in FIG. 4 is implemented by the CPU 72 repeatedly executing programs stored in the ROM 74 at a specific interval.

In the series of processes shown in FIG. 4, the CPU 72 first determines whether the temperature increasing process is being executed (S200). When determining that the temperature increasing process is being executed (S200: YES), the CPU 72 executes an updating process for a gradual change port injection ratio RPde (S210) as the increase limiting process. The gradual change port injection ratio RPde is the port injection ratio RP set during the execution of the temperature increasing process, and the updating process reduces the port injection ratio RP over time.

As the updating process, the CPU 72 executes a process that sets the gradual change port injection ratio RPde to a new value obtained by subtracting a defined value A from the current gradual change port injection ratio RPde. The initial value of the gradual change port injection ratio RPde is the value of the port injection ratio RP when the temperature increasing process that is determined to be being executed in the process of S200 was started. The defined value A is set in advance to a value that minimizes adverse influence of a change in the port injection ratio RP on the engine operating state. During the execution of the temperature increasing process, the value of the gradual change port injection ratio RPde decreases by the defined value A each time the process of S210 is executed.

After executing the process of S210, the CPU 72 next determines whether the gradual change port injection ratio RPde, which has been updated in S210, is greater than or equal to a threshold α (S220). In the present embodiment, the threshold α is set to 0. However, the value may be changed.

When determining that the gradual change port injection ratio RPde is greater than or equal to the threshold α (S220: YES), the CPU 72 sets the port injection ratio RP to the gradual change port injection ratio RPde that has been updated in S210 (S230). Then, the CPU 72 executes the processes starting from S120 shown in FIG. 3.

When determining that the gradual change port injection ratio RPde is less than the threshold α in S220 (S220: NO), the CPU 72 sets the port injection ratio RP to 0 (S240). For example, the CPU 72 sets the port injection ratio RP to the threshold α. Then, the CPU 72 executes the processes starting from S120 shown in FIG. 3.

When making a negative determination in the process of S200, the CPU 72 temporarily suspends the series of processes shown in FIG. 4.

<Operation and Advantages of Present Embodiment>

Operation and advantages of the present embodiment will now be described.

(2-1) The updating process, which reduces the port injection ratio RP over time, reduces the port injection ratio RP over time during the execution of the temperature increasing process. Accordingly, the fuel injection amount of the port injection valves 16 gradually decreases. As the port injection amount gradually decreases, new fuel is unlikely to adhere to the intake ports 12*a*, which limits increases in the adhered fuel amount. This limits increases in the displacement of the air-fuel ratio from the proper value.

(2-2) When the port injection amount decreases gradually, the fuel adhered to the intake ports 12*a* gradually decreases. That is, the adhered fuel amount decreases. Accordingly, the displacement of the air-fuel ratio from the proper value is reduced.

(2-3) The processes of S220 and S230 shown in FIG. 4 reduce the port injection ratio RP during the execution of the temperature increasing process to 0, to which the threshold α has been set. After the port injection ratio RP is reduced to 0, fuel injection from the port injection valves 16 is stopped. This further enhances the above-described advantages (2-1) and (2-2).

(2-4) During the execution of the temperature increasing process, the port injection ratio RP decreases over time. Thus, for example, as compared to a case in which the port injection ratio RP is set to 0 immediately after the start of the temperature increasing process, the engine operating state is prevented from being changed abruptly due to a change in the port injection ratio RP.

In the first embodiment, the process that stops the port injection is executed as the increase limiting process that limits increases in the adhered fuel amount on the intake ports 12*a*. In a third embodiment, the increase limiting process is executed in a manner different from that in the first embodiment.

The third embodiment will now be described with reference to FIG. 5. Differences from the processes according to the first embodiment shown in FIG. 3 will mainly be discussed.

<Increase Limiting Process>

Figure 5:
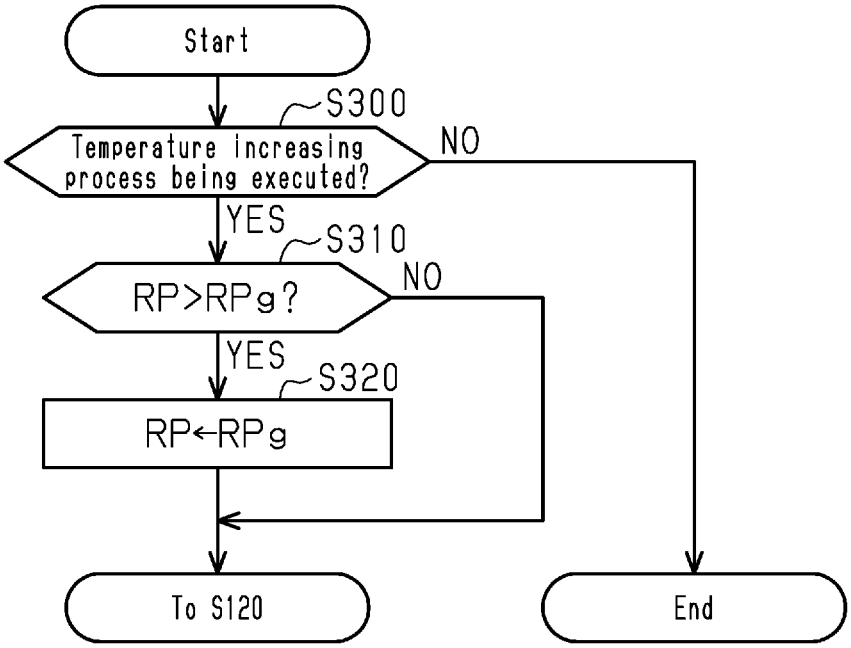
FIG. 5 is a flowchart showing a procedure of part of a process executed by a controller according to a third embodiment.

FIG. 5 shows a procedure of processes according to the present embodiment. The process shown in FIG. 5 is implemented by the CPU 72 repeatedly executing programs stored in the ROM 74 at a specific interval.

In the series of processes shown in FIG. 5, the CPU 72 first determines whether the temperature increasing process is being executed (S300). When determining that the temperature increasing process is being executed (S300: YES), the CPU 72 determines whether the current port injection ratio RP is greater than a guard value RPg (S310). The guard value RPg is the value of the port injection ratio RP obtained by the CPU 72 when the temperature increasing process that is determined to be being executed in the process of S300 was started.

When determining that the port injection ratio RP is greater than the guard value RPg (S310: YES), the CPU 72 the guard value RPg for the port injection ratio RP, thereby executing a guard process for the port injection ratio RP (S320). Then, the CPU 72 executes the above-described processes starting from S120 shown in FIG. 3.

When determining that the port injection ratio RP is less than the guard value RPg (S310: NO), the CPU 72 executes the processes starting from S120 without executing the process of S320.

When making a negative determination in the process of S300, the CPU 72 temporarily suspends the series of processes shown in FIG. 5.

<Operation and Advantages of Present Embodiment>

Operation and advantages of the present embodiment will now be described.

(3-1) During the execution of the temperature increasing process, the processes of S310 and S320 are executed. This restricts the port injection ratio RP from exceeding the value of the port injection ratio RP at the start of the temperature increasing process (RPg). The restriction on the port injection ratio RP limits increases in the port injection amount. Accordingly, new fuel is unlikely to adhere to the intake ports 12*a*, which limits increases in the adhered fuel amount. This limits increases in the displacement of the air-fuel ratio from the proper value.

<Modifications>

The above-described embodiments may be modified as follows. The above-described embodiments and the following modifications can be combined as long as the combined modifications remain technically consistent with each other.

In the process of FIG. 3, it is possible to omit S120 and S130 of the changing process, which changes the split injection count N. The changing process, which reduces the split injection count N (S120, S130), does not necessarily need to be executed in S110 of FIG. 3, but may be executed in S230 or S240 in FIG. 4, or in S310 or S320 in FIG. 5.

The specific condition for allowing the temperature increasing process of S20 in FIG. 2 to be executed is not limited to that described in the above-described embodiments. For example, the condition may include only one of Condition (A) and Condition (B). Alternatively, the specific condition may include another condition in addition to the above-described two conditions.

In order to compensate for the reduction in the engine output due to the execution of the partial fuel cut-off process in S22 shown in FIG. 2, the compensation torque is superimposed on the torque required for the second motor-generator 54 in the process of S24 shown in FIG. 2. Alternatively, in a case of a vehicle that is not equipped with the second motor-generator 54, the amount of air and the amount of fuel supplied to the combustion cylinders may be increased so as to increase the output torque of the combustion cylinders except the fuel cut-off cylinder. The reduction in the engine output may be compensated for in this manner.

A process that estimates the accumulated amount DPM is not limited to that illustrated in S10 shown in FIG. 2. The accumulated amount DPM may be estimated based on the intake air amount Ga and the pressure difference between the upstream side and the downstream side of the GPF 34. Specifically, the accumulated amount DPM may be estimated to be larger when the pressure difference is relatively large than when the pressure difference is relatively small. Also, even if the pressure difference is the same, the accumulated amount DPM may be estimated to be larger when the intake air amount Ga is relatively small than when the intake air amount Ga is relatively large. In a case in which the pressure on the downstream side of the GPF 34 is regarded to be constant, the pressure on the upstream side of the GPF 34 can be used in place of the pressure difference.

The process that executes the partial fuel cut-off process of S22 shown in FIG. 2 is not limited to the above-described regeneration process. For example, the partial fuel cut-off process may be executed to perform the catalyst warm-up or the sulfur release process.

The process that executes the partial fuel cut-off process is not limited to the above-described regeneration process. For example, when the oxygen storage amount of the three-way catalyst 32 is less than or equal to a defined value, the combustion operation of only the fuel cut-off cylinder may be stopped, and control may be performed to cause the air-fuel ratio of the air-fuel mixture in the combustion cylinders, which correspond to the remaining cylinders, to be the stoichiometric air-fuel ratio.

In the above-described embodiments, when the partial fuel cut-off process is executed, the number of the fuel cut-off cylinders, or the number of the reduced-injection cylinders, in which the combustion operation is stopped, is 1. However, the number of the fuel cut-off cylinders, in which the combustion operation is stopped, may be changed up to the total number of the cylinders of the internal combustion engine minus 1. Also, the fuel cut-off cylinder, in which the combustion operation is stopped, does not necessarily need to be a predetermined cylinder. For example, the fuel cut-off cylinder may be changed every combustion cycle.

The injection reducing process is not limited to the above-described partial fuel cut-off process. For example, the fuel injection amount of the reduced-injection cylinder, which corresponds to one or some of the cylinders, may be caused to be less than the fuel injection amount of the other cylinders, so that the air-fuel ratio of the air-fuel mixture of the reduced-injection cylinder is leaner than the stoichiometric air-fuel ratio. Further, dither control may be performed that causes the air-fuel ratio of the air-fuel mixture in the remaining cylinders except the reduced-injection cylinder to be richer than the stoichiometric air-fuel ratio.

In the above-described embodiments, the port injection ratio RP is set based on the engine operating state, and the direct injection ratio RD is set to (1−RP). Alternatively, the direct injection ratio RD may be set based on the engine operating state, and the port injection ratio RP may be set to (1−RD).

The GPF 34 is not limited to a filter supporting a three-way catalyst, but may be a simple filter. The GPF 34 does not necessarily need to be placed on the downstream side of the three-way catalyst 32 in the exhaust passage 30. The three-way catalyst 32 may be replaced by an oxidation catalyst that oxidizes components contained in exhaust gas. Also, the exhaust purification member that does not necessarily include the GPF 34.

The controller 70 is not limited to a device that includes the CPU 72 and the ROM 74 and executes software processing. For example, at least part of the processes executed by the software in the above-described embodiments may be executed by hardware circuits dedicated to executing these processes (such as an application-specific integrated circuit (ASIC)). That is, the controller 70 may be modified as long as it has any one of the following configurations (a) to (c). (a) A configuration including a processor that executes all of the above-described processes according to programs and a program storage device such as a ROM (including a non-transitory computer readable medium) that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. Multiple software processing devices each including a processor and a program storage device and multiple dedicated hardware circuits may be provided.

The vehicle is not limited to a series-parallel hybrid vehicle, but may be a parallel hybrid vehicle or a series hybrid vehicle. Further, the vehicle is not limited to a hybrid electric vehicle, but may be a vehicle that includes only the internal combustion engine 10 as a drive force generator.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A controller for an internal combustion engine, wherein
- the internal combustion engine for which the controller is used includes:
  - cylinders;
  - port injection valves that inject fuel into intake ports; and
  - direct injection valves that inject fuel into the cylinders, and
- the controller is configured to execute
  - a process that changes a port injection ratio according to an engine operating state of the internal combustion engine, the port injection ratio being a ratio of a port injection amount that is an amount of fuel injected by the port injection valves to an amount of fuel supplied to the cylinders from the port injection valves and the direct injection valves,
  - an injection reducing process that causes a fuel injection amount in a reduced-injection cylinder to be smaller than a fuel injection amount in other cylinders, the reduced-injection cylinder being one or some of the cylinders, and
  - an increase limiting process that limits increases in an adhered fuel amount in the intake ports by regulating the port injection ratio during execution of the injection reducing process.

2. The controller for the internal combustion engine according to claim 1, wherein the increase limiting process includes a process that reduces the port injection ratio over time.

3. The controller for the internal combustion engine according to claim 1, wherein the increase limiting process includes a process that stops a port injection that is a fuel injection from the port injection valves.

4. The controller for the internal combustion engine according to claim 1, wherein the increase limiting process includes a process that limits the port injection ratio such that the port injection ratio does not exceed a value of the port injection ratio at a start of the injection reducing process.

5. The controller for the internal combustion engine according to claim 1, wherein the controller is configured to
- perform a split injection in which fuel injection of the direct injection valves is split to two or more injections, and
- execute a changing process that reduces a split injection count during execution of the injection reducing process.

6. The controller for the internal combustion engine according to claim 1, wherein the controller is configured to
- perform an air-fuel ratio feedback control for an air-fuel mixture when the injection reducing process is not being executed, and
- prohibiting the air-fuel ratio feedback control when the injection reducing process is being executed.

7. A control method for an internal combustion engine, wherein
- the internal combustion engine in which the control method is performed includes:
  - cylinders;
  - port injection valves that inject fuel into intake ports; and
  - direct injection valves that inject fuel into the cylinders, and
- the control method comprises:
  - changing a port injection ratio according to an engine operating state of the internal combustion engine, the port injection ratio being a ratio of a port injection amount that is an amount of fuel injected by the port injection valves to an amount of fuel supplied to the cylinders from the port injection valves and the direct injection valves;
  - executing an injection reducing process that causes a fuel injection amount in a reduced-injection cylinder to be smaller than a fuel injection amount in other cylinders, the reduced-injection cylinder being one or some of the cylinders; and
  - limiting increases in an adhered fuel amount in the intake ports by regulating the port injection ratio during execution of the injection reducing process.

8. A non-transitory computer readable medium that stores a program that causes a processor to execute a control process for an internal combustion engine, wherein
- the internal combustion engine for which the control process is executed includes:
  - cylinders;
  - port injection valves that inject fuel into intake ports; and
  - direct injection valves that inject fuel into the cylinders, and
- the control process includes:
  - changing a port injection ratio according to an engine operating state of the internal combustion engine, the port injection ratio being a ratio of a port injection amount that is an amount of fuel injected by the port injection valves to an amount of fuel supplied to the cylinders from the port injection valves and the direct injection valves;

executing an injection reducing process that causes a fuel injection amount in a reduced-injection cylinder to be smaller than a fuel injection amount in other cylinders, the reduced-injection cylinder being one or some of the cylinders; and limiting an increase in an adhered fuel amount in the intake ports by regulating the port injection ratio during execution of the injection reducing process.

* * * * *